US006119782A

United States Patent [19]

Flores et al.

[11] Patent Number: 6,119,782

[45] Date of Patent: Sep. 19, 2000

[54] METHOD AND APPARATUS FOR ANCHORING A TOOL WITHIN A CASED BOREHOLE

[75] Inventors: Mario J. Flores, Houston; Aaron G. Flores; Mark Hinton, both of Sugar Land; John C. Ratcliff, Missouri City, all of Tex.

[73] Assignee: Gas Research Institute, Chicago, Ill.

[21] Appl. No.: 09/132,917

[22] Filed: Aug. 12, 1998

[51] Int. Cl.[7] ..... E21B 33/12; E21B 47/01

[52] U.S. Cl. ..... 166/382; 166/100; 166/120; 166/212; 166/387

[58] Field of Search ..... 166/55.1, 100, 166/120, 134, 212, 242.1, 264, 382, 387

[56] References Cited

U.S. PATENT DOCUMENTS

| | | | |
|---|---|---|---|
| 2,313,176 | 3/1943 | Shelby | 166/100 |
| 2,588,717 | 3/1952 | Goodwin | 73/152.17 |
| 3,244,253 | 4/1966 | Blizard . | |
| 3,344,860 | 10/1967 | Voetter . | |
| 4,050,529 | 9/1977 | Tagirov et al. | 166/100 X |
| 4,158,388 | 6/1979 | Owen et al. | 166/100 X |
| 4,369,654 | 1/1983 | Hallmark | 73/152.51 X |
| 4,470,456 | 9/1984 | Montray, III | 166/100 |
| 4,898,237 | 2/1990 | Wittrisch | 166/66 |
| 5,056,595 | 10/1991 | Desbrandes | 166/100 |
| 5,062,482 | 11/1991 | Graham | 166/100 X |
| 5,220,959 | 6/1993 | Vance, Sr. | 166/212 X |
| 5,542,473 | 8/1996 | Pringle et al. | 166/387 X |
| 5,585,555 | 12/1996 | McRae | 73/152.17 |
| 5,692,565 | 12/1997 | MacDougall et al. | 166/264 |
| 5,881,807 | 3/1999 | Boe et al. | 166/100 |
| 6,026,915 | 2/2000 | Smith et al. | 166/100 X |

FOREIGN PATENT DOCUMENTS 0 178 784 4/1986 European Pat. Off. .

*Primary Examiner*—George Suchfield
*Attorney, Agent, or Firm*—Pauley Petersen Kinne & Fejer

[57] ABSTRACT

A method and apparatus for anchoring a tool within a cased borehole wherein at least one piston connected with respect to the tool includes an associated anchor shoe. The anchor shoe has a penetration means, such as a plurality of wheels having a sharp outer periphery, for engagement with the cased borehole. A packer having a rigid component, such as a plurality of concentric rings, is connected with respect to the tool, opposite the piston. The packer may also have a sealing member for creating a sealed engagement between the tool and the cased borehole. When the piston is extended, the anchor shoe contacts the cased borehole and centers the tool with respect to the cased borehole. When the piston is extended, the packer also engages the cased borehole and maintains the position of the tool as well as creating a sealed connection between the tool and the cased borehole.

20 Claims, 3 Drawing Sheets

METHOD AND APPARATUS FOR ANCHORING A TOOL WITHIN A CASED BOREHOLE

BACKGROUND OF THE INVENTION

1. Field of the Invention

This invention relates to a method and apparatus for anchoring a tool in an accurate and stable manner in a cased borehole for use in high pressure environments.

2. Description of the Prior Art

Oil and natural gas welling requires drilling a borehole through an earth formation. The borehole must accommodate welling and drilling equipment as well as inflow and outflow of various fluids through the borehole and the surrounding earth formation. Typically, during the preparation and maintenance of an earth formation borehole, steel casing is used in one or more sections of the borehole to stabilize and provide support for the formation surrounding the borehole. Cement is poured on the outside of the casing to support the casing and provide a seal between the formation and the casing.

There are thousands of abandoned oil and gas wells around the United States and many more worldwide. Recent research has indicated that large amounts of unrecovered oil and natural gas may be present in such abandoned wells. Recovering this unrecovered oil and natural gas may be financially attractive because the majority of the field development costs such as drilling, casing and cementing have already been incurred in the abandoned wells.

Various testing equipment exists that perforates the casing and the cement surrounding the borehole in order to test the surrounding formations for additional retrievable resources. This testing equipment must operate in harsh environments, often at great depths and under great pressures.

MacDougall et al., U.S. Pat. No. 5,692,565, discloses one such testing device for sampling an earth formation surrounding a cased borehole. The MacDougall et al. patent teaches a testing device that requires a means for setting the device at a substantially fixed location. The testing device according to the MacDougall et al. patent requires a substantially fixed location so that various drilling and plugging tools may be used during the testing and sampling of the formation surrounding the cased borehole.

SUMMARY OF THE INVENTION

It is one object of this invention to provide an apparatus for securely anchoring a tool within a cased borehole to prevent excess movement of the tool with respect to the cased borehole.

It is another object of this invention to provide an apparatus for creating a sealed engagement with a cased borehole to prevent exchange of fluids between the cased borehole and an interior of the tool.

It is another object of this invention to provide an apparatus that penetrates a cased borehole to prevent slippage of the tool with respect to the cased borehole.

It is a further object of this invention to provide an anchor shoe on a tool that centralizes the tool with respect to the cased borehole.

It is yet another object of this invention to provide a packer on a tool that penetrates a cased borehole and seals the testing device with respect to the cased borehole.

A method and apparatus for according to one preferred embodiment of this invention comprises a tool, or testing device, having an internal testing apparatus and an external anchoring apparatus for securely and sealingly positioning the tool with respect to a borehole. Optimally, the tool is anchored in an aligned position with respect to an imaginary centerline of the borehole.

The anchoring apparatus for anchoring the tool within the borehole preferably comprises a piston attached to the tool, the piston having an anchor shoe associated with an unattached end of the piston.

The anchor shoe preferably includes a leading edge having an outwardly curved surface with an apex at an approximate center of the anchor shoe. Penetration means are preferably connected with respect to the leading edge of the anchor shoe. Penetration means preferably comprise a plurality of rollers, such as wheels, having a sharpened outer periphery, with at least one roller positioned on each side of the center of the anchor shoe.

Preferably, the anchoring apparatus also comprises a packer connected with respect to the tool, on an opposite surface of the tool as the one or more pistons. The packer preferably contains a rigid member and a sealing member. The rigid member of the packer preferably comprises a plurality of concentric rings, each constructed from a rigid, corrosion-resistant material and having a sharp leading edge. The sealing member of the packer preferably comprises at least one flexible gasket connected with respect to at least one concentric ring.

In a method for anchoring the tool within the cased borehole, the piston is extended away from the tool toward the internal surface of the borehole. The outward extension of the piston forces the anchor shoe into engagement with the internal surface, or casing, of the borehole. The anchor shoe, through the sharpened outer periphery of the rollers, preferably penetrates the internal surface of the borehole. Such penetration, and the extension of the piston into engagement with the internal surface of the borehole, fixes the tool into a vertical position with respect to the borehole.

Simultaneously, the packer preferably engages with the internal surface of the borehole on an opposite side of the tool from the piston. Similar to the rollers of the anchor shoe, the packer penetrates the internal surface of the borehole. As the pistons mechanically project from the tool, the pistons force the packer against the casing, thus forming a pressure-tight seal between the tool and the casing and also maintaining a fixed vertical position of the tool with respect to the casing.

The arrangement of the anchor shoe also aligns the packer with respect to the centerline through the borehole. Such alignment promotes a good seal between the internal components of the tool and the earth formation thereby avoiding damage and contamination to internal components of the tool from the contents of the borehole.

BRIEF DESCRIPTION OF THE DRAWINGS

The above-mentioned and other features and objects of this invention will be better understood from the following detailed description taken in conjunction with the drawings wherein.

DESCRIPTION OF THE PREFERRED EMBODIMENTS

Figure 1:
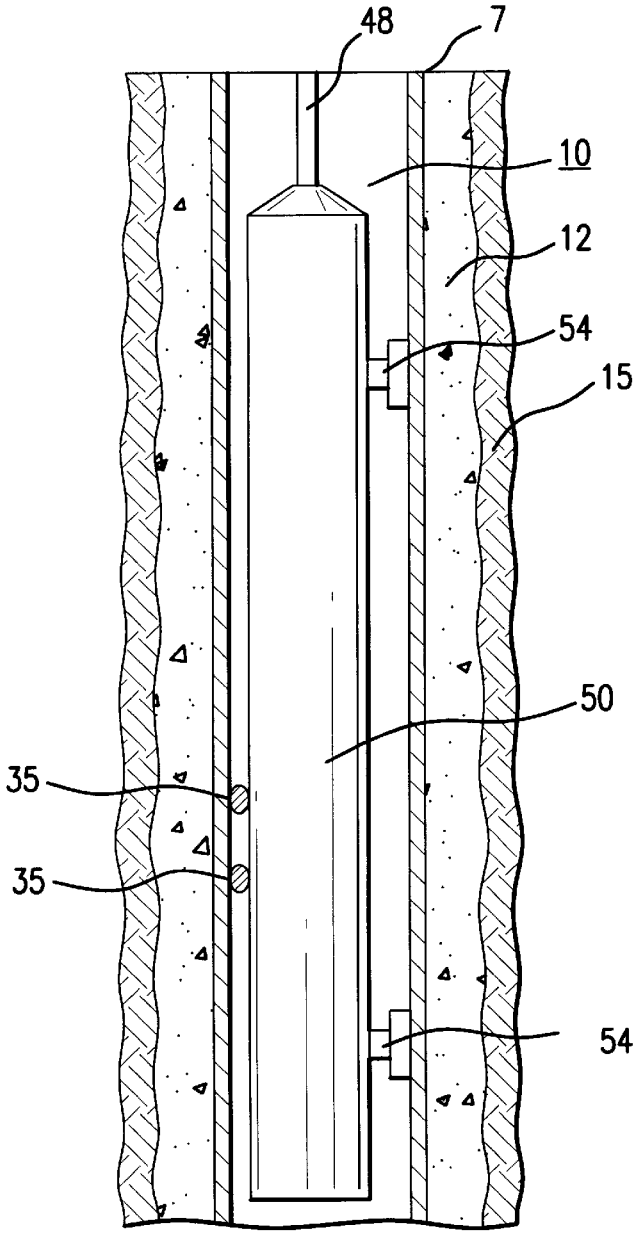
FIG.1 PRIOR ART
FIG. 1 is a diagrammatic side view of a tool anchored within a borehole using a prior art anchoring apparatus.

FIG. 1 shows tool 50, or testing device, having a prior art anchoring apparatus. Tool 50 is positioned within borehole 10 for taking appropriate measurements. Tool 50 is suspended on cable 48 inside borehole 10 which is preferably lined with casing 7 material, such as steel. Cement 12 preferably supports casing 7 and divides casing 7 from formation 15. Borehole 10 is typically filled with water or a completion fluid.

Tool 50 is raised and lowered through borehole 10 to the proper level within borehole 10 to accomplish specific predetermined tasks. Tool 50 preferably has a generally cylindrical body which preferably encloses various testing equipment, drilling equipment, pumping equipment and/or any other necessary equipment or apparatus for use in a natural gas or oil well. According to one preferred embodiment of this invention, tool 50 contains testing apparatus for testing and sampling formation 15 surrounding borehole 10 to determine the presence of retrievable natural resources. In this preferred embodiment of the invention, tool 50 is anchored with respect to casing 7 in borehole 10 and measures relevant variables used to determine the nature of formation 15 surrounding borehole 10.

Figure 2:
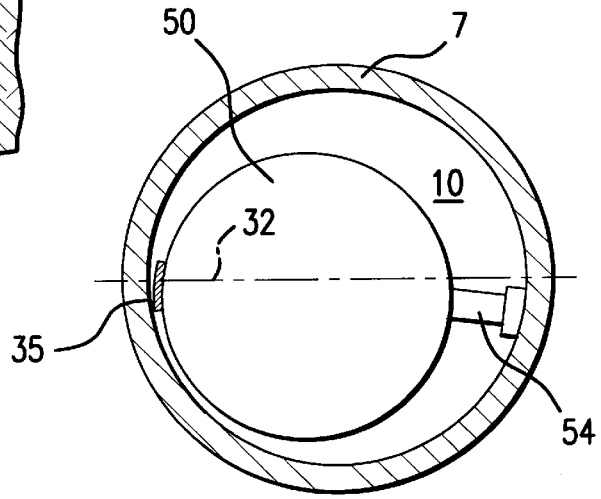
FIG.2 PRIOR ART
FIG. 2 is a diagrammatic top view of the tool and anchoring apparatus shown in FIG. 1.

FIG. 2 shows a top view of a prior art anchoring apparatus comprising anchor piston 54 and packer 35. One or more anchor pistons 54 are positioned with respect to tool 50 which is preferably a cylindrical or generally elongated element. Anchor pistons 54 are radially positioned with respect to tool 50 and mechanically project away from tool 50 or retract toward tool 50, depending upon an electronic signal. Preferably, prior art anchoring apparatus also comprise packer 35 positioned on an opposite side from anchor pistons 54. As anchor pistons 54 are mechanically projected away from tool 50 and against casing 7, anchor pistons 54 force packer 35 against casing 7 forming a pressure-tight seal between tool 50 and casing 7 and maintaining a fixed vertical position of tool 50 with respect to casing 7. After packer 35 is sealed against casing 7, an internal portion of tool 50 is co-operable with casing 7, ideally without risk of contamination from completion fluid or water in borehole 10.

As shown in FIG. 2, the prior art configuration of anchor piston 54 and packer 35 may result in a tool 50 position which is misaligned with respect to an imaginary centerline 32 within borehole 10. Such misalignment, often 6°–7°, may result in incomplete contact between packer 35 and casing 7 thus causing an incomplete seal between packer 35 and casing 7. An incomplete seal may cause damage and contamination of internal components of tool 50 from completion fluid, water, dirt, oil and other contaminants thus resulting in costly repairs or replacement. A misaligned tool 50 may also result in inaccurate or incomplete testing measurements and data because of a longer measurement path to formation 15 through casing 7 and cement 12.

Figure 3:
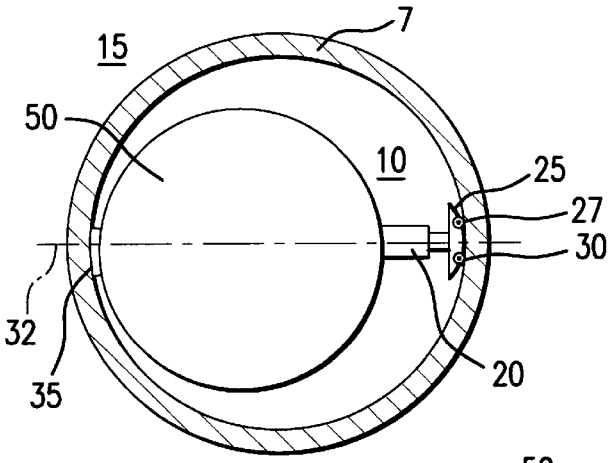
FIG. 3 is a diagrammatic top view of a tool and anchoring apparatus according to one preferred embodiment of the invention.

An apparatus for anchoring tool 50 within borehole 10 according to one preferred embodiment of this invention is shown in FIG. 3. As shown in FIG. 3, anchor shoe 25 is preferably associated with piston 20, either directly, or through an intermediate connection. Also as shown in FIG. 3, piston 20 is also connected with respect to tool 50, on an opposite side from anchor shoe 25.

Figure 6:
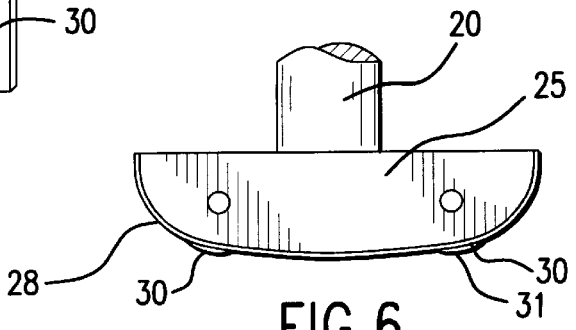
FIG. 6 is a side view of the anchor shoe shown in FIG. 5.

FIG. 6 shows anchor shoe 25 which preferably includes leading edge 28 having an outwardly curved surface. Such curved surface preferably has an apex approximately at a center of anchor shoe 25. In one preferred embodiment of the invention, the curved surface roughly corresponds with the curved internal surface of borehole 10. This preferred embodiment of anchor shoe 25 prevents exterior edges of leading edge 28 from digging into casing 7 within borehole 10.

Figure 5:
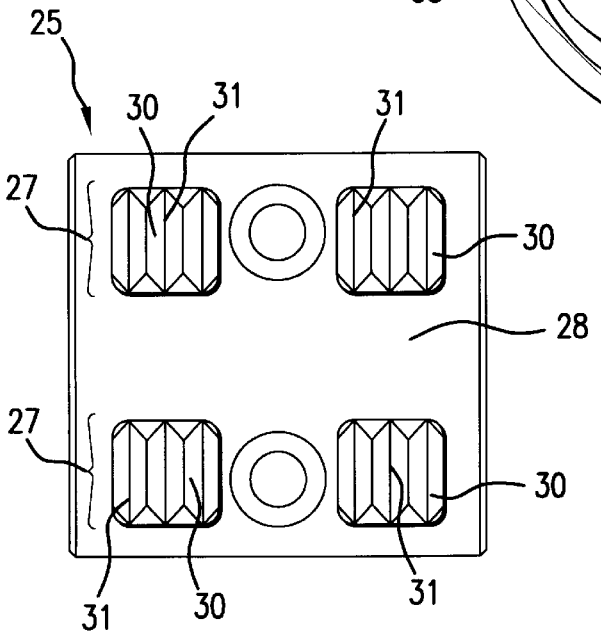
FIG. 5 is a bottom view of an anchor shoe according to one preferred embodiment of the invention.

In one preferred embodiment of this invention, shown in FIGS. 3, 5 and 6, anchor shoe 25 comprises penetration means 27 for engagement with borehole 10. Preferably, penetration means 27 comprises a plurality of rollers 30. Rollers 30 are preferably wheels, discs or other configuration which will roll across a hard surface. Penetration means 27 may alternatively comprise alternative configurations which will likewise roll or glide across hard surfaces.

According to one preferred embodiment of this invention, penetration means 27, such as rollers 30, are connected with respect to leading edge 28 of anchor shoe 25. Preferably, at least one roller 30 is positioned on each side of the center of anchor shoe 25. Positioning at least one roller 30, and preferably an equal amount of rollers 30, on each side of the center, or the approximate center, of anchor shoe 25 maintains anchor shoe 25 in a centered position with respect to borehole 10. In a preferred embodiment of the invention shown in FIG. 5, one set of three rollers 30 is positioned in each of four comers of leading edge 28 of anchor shoe 25. Such an arrangement of four sets of rollers 30 further maintains anchor shoe 25 in a centered position with respect to borehole 10 and prevents excessive wear on each roller 30.

In one preferred embodiment of this invention shown in FIG. 5, at least one roller 30 comprises a wheel having a generally sharp outer periphery 31. Roller 30 is preferably constructed from a rigid, corrosion-resistant material such as steel. The generally sharp outer periphery 31 is preferably resistant to dulling. In a preferred embodiment of this invention, outer periphery 31 has a shallow cutting edge. A shallow cutting edge prevents generation of a flat spot of outer periphery 31 due to wear or a hard spot in casing 7. Such a flat spot in outer periphery 31 of roller 30 would prevent roller 30 from performing in an optimal manner.

Figure 4:
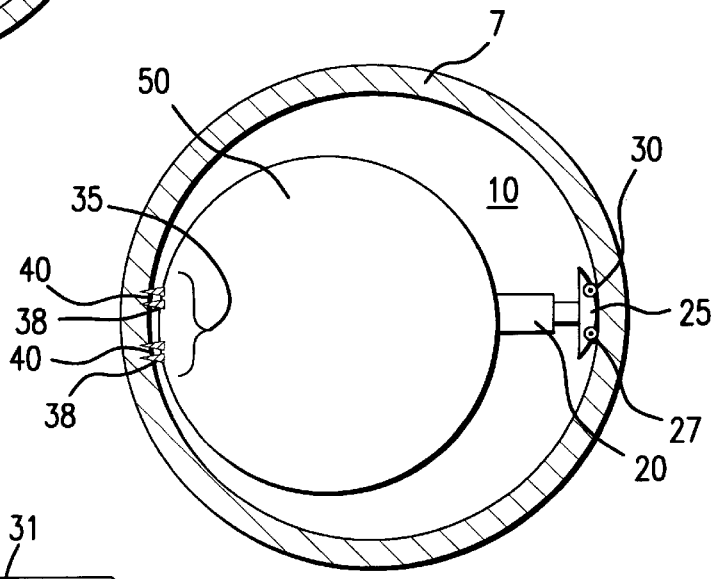
FIG. 4 is a diagrammatic top view of a tool and anchoring apparatus according to another preferred embodiment of the invention.

In one preferred embodiment of this invention shown in FIG. 4, packer 35 is connected with respect to a surface of tool 50. Packer 35 is preferably connected with respect to tool 50 on an opposite surface as the one or more pistons 20 and anchor shoes 25. Packer 35 preferably contains a rigid member and, in one preferred embodiment of this invention, a sealing member.

Figure 7:
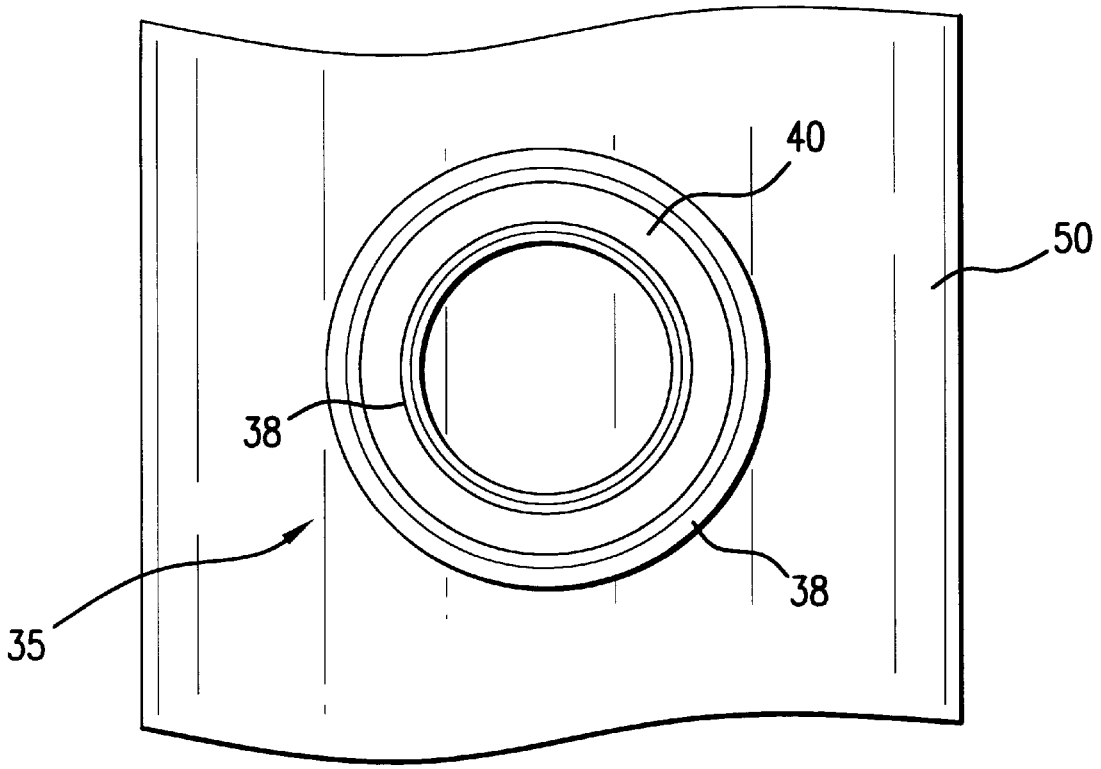
FIG. 7 is a diagrammatic front view of a tool and packer according to one preferred embodiment of the invention.

As shown in FIGS. 4 and 7, the rigid member of packer 35 comprises a plurality of concentric rings 38. Concentric rings 38 are preferably constructed from a rigid, corrosion-resistant material such as steel. Concentric rings 38 preferably each have a sharpened leading edge.

In one preferred embodiment of this invention, the sealing member of packer 35 further comprises at least one flexible gasket 40 connected with respect to at least one concentric ring 38. Gasket 40 may comprise an O-ring or other sealing member known to those having ordinary skill in the art. Preferably gasket 40 is positioned around a perimeter of one or more concentric ring 38. Gasket 40 is preferably of similar thickness as concentric ring 38.

In one preferred embodiment of this invention, packer 35 comprises a plurality of concentric rings 38 and a plurality of gaskets 40, each gasket 40 positioned adjacent each concentric ring 38. Such arrangement permits packer 35 to both penetrate internal surface or casing 7 of borehole 10 and seal an area within the perimeter of concentric rings 38 with respect to borehole 10.

In a method for anchoring tool 50 within borehole 10 according to a preferred embodiment of this invention, piston 20 is extended away from tool 50 toward the internal surface or casing 7 of borehole 10. Piston 20 extends outward from tool 50 thus forcing anchor shoe 25 into engagement with the internal surface, or casing 7, of borehole 10.

Anchor shoe 25, through sharpened outer periphery of rollers 30, preferably penetrates the internal surface or casing 7 of borehole 10. Such penetration, and the extension of piston 20 into engagement with the internal surface or casing 7 of borehole 10, fixes tool 50 into a vertical position with respect to borehole 10.

FIG. 3 shows a top view of an anchoring apparatus according to one preferred embodiment of this invention, comprising piston 20, anchor shoe 25 and packer 35. One or more pistons 20, each having at least one anchor shoe 25, are positioned with respect to tool 50 which is preferably a cylindrical or generally elongated element. Pistons 20 are preferably radially positioned with respect to tool 50 and mechanically project away from tool 50 or retract toward tool 50, depending upon a signal sent by the user.

When piston 20 is in a fully extended position, anchor shoe 25 engages with the internal surface or casing 7 of borehole 10. Preferably, rollers 30 or other penetration means 27 engage with casing 7 in a non-destructive manner, thus maintaining the integrity of casing 7 adjacent anchor shoe 25.

Packer 35 preferably engages with the internal surface or casing 7 of borehole 10 on an opposite side of tool 50 from piston 20 and anchor shoe 25. When piston 20 is in an extended position and anchor shoe 25 is engaged with the internal surface of borehole 10, packer 35 is likewise engaged with the internal surface or casing 7 of borehole 10. Similar to rollers 30, packer 35 preferably penetrates the internal surface or casing 7 of borehole 10. As pistons 20 mechanically project away from tool 50 and against casing 7, pistons 20 force packer 35 against casing 7 forming a pressure-tight seal between tool 50 and casing 7 and maintaining a fixed vertical position of tool 50 with respect to casing 7. After packer 35 is sealed against casing 7, an internal portion of tool 50, also called a tool string, is co-operable with casing 7 without risk of contamination from completion fluid or water in borehole 10.

As shown in FIG. 3 and contrary to the prior art device shown in FIG. 2, the arrangement of anchor shoe 25, including curved leading edge 28 and rollers 30, aligns packer 35 with respect to an imaginary centerline 32 through borehole 10. Such alignment promotes a good seal between the internal components of tool 50 and formation 15. According to a preferred embodiment of this invention, tool 50 will be aligned within at least 2° of the centerline 32 of borehole 10. Alignment also results in complete contact between packer 35 and casing 7 thus avoiding damage and contamination of internal components of tool 50 from completion fluid, water, dirt, oil and other contaminants thus resulting in costly repairs or replacement. An aligned tool 50 also results in accurate and complete testing measurements and data from formation 15.

Preferably, tool 50 is fixed into a vertical position by the penetration of both packer 35 and anchor shoe 35. Such penetration enables tool 50 to maintain a vertical position despite severe pressures and turbulent fluid flows within borehole 10 and despite the internal movement of testing equipment within tool 50. The level of penetration and thus the level of stability of tool 50 may be controlled by varying the force exerted by piston 20 with respect to the internal surface or casing 7 of borehole 10. The level of penetration must be determined by balancing the required stability against the potential for damage of anchor shoe 25, packer 35 and the internal surface or casing 7 of borehole 10.

While in the foregoing specification this invention has been described in relation to certain preferred embodiments thereof, and many details have been set forth for purpose of illustration, it is to be understood, as aforementioned, that this invention is susceptible to additional embodiments and that certain of the details described herein can be varied considerably without departing from the basic principles of the invention expressed herein.

We claim:

1. An apparatus for anchoring a tool within a cased borehole, the apparatus comprising:

at least one piston connected with respect to the tool;

an anchor shoe associated with the piston, the anchor shoe having a penetration means for engagement with the cased borehole; and a packer connected with respect to a surface of the tool, the packer having a rigid component.

2. The apparatus of claim 1 wherein the anchor shoe comprises a leading edge having an outwardly curved surface, the curved surface having an apex approximately at a center of the anchor shoe.

3. The apparatus of claim 2 wherein the penetration means comprises a plurality of rollers connected with respect to the leading edge of the anchor shoe.

4. The apparatus of claim 3 wherein at least one roller of the rollers is positioned on each side of the center of the anchor shoe.

5. The apparatus of claim 1 wherein the penetration means comprises a plurality of rollers connected with respect to a leading edge of the anchor shoe.

6. The apparatus of claim 5 wherein at least one roller of the rollers comprises a wheel having a generally sharp outer periphery.

7. The apparatus of claim 1 wherein the rigid component of the packer comprises a plurality of concentric rings each having a sharpened leading edge.

8. The apparatus of claim 7 wherein the packer further comprises at least one flexible gasket member connected with respect to at least one concentric ring of the concentric rings.

9. An apparatus for anchoring a tool within a cased borehole, the apparatus comprising:

at least one piston connected with respect to the tool;

an anchor shoe associated with the piston, the anchor shoe having a leading edge with an outwardly curved surface, the curved surface having an apex approximately at a center of the anchor shoe; and a packer connected with respect to an external surface of the tool, the packer comprising a sealing member and a rigid member having a generally sharp leading edge.

10. The apparatus of claim 9 further comprising a plurality of rollers connected with respect to the leading edge of the anchor shoe.

11. The apparatus of claim 10 wherein at least one roller of the rollers is positioned on each side of the center of the anchor shoe.

12. The apparatus of claim 9 wherein the anchor shoe comprises a plurality of rollers connected with respect to the leading edge of the anchor shoe.

13. The apparatus of claim 12 wherein at least one roller of the rollers comprises a wheel having a generally sharp outer periphery.

14. The apparatus of claim 9 wherein the sealing member comprises at least one O-ring connected with respect to the rigid member.

15. The apparatus of claim 9 wherein the rigid member comprises two or more concentric rings connected with respect to the sealing member.

16. An apparatus for anchoring and aligning a tool in a cased borehole, the apparatus comprising:

at least one piston connected with respect to the tool;

an anchor shoe associated with the at least one piston, the anchor shoe having a generally curved leading surface and a centerline passing through an approximate apex of the anchor shoe; and at least one penetration means positioned on each side of the centerline of the anchor shoe.

17. The apparatus of claim 16 wherein the penetration means comprises a plurality of rollers, each of the rollers having an edge extending from the curved leading surface of the anchor shoe.

18. The apparatus of claim 17 wherein at least one roller of the rollers comprises a wheel having a generally sharp outer periphery.

19. A method for anchoring a tool within a cased borehole, the method comprising:

extending at least one piston connected with respect to the tool toward an internal surface of the cased borehole;

penetrating the internal surface of the cased borehole with an anchor shoe associated with the piston; and penetrating an opposing internal surface of the cased borehole with a packer connected with respect to the tool.

20. The method of claim 19 further comprising aligning the packer with respect to the opposing internal surface of the cased borehole with a plurality of rollers connected with respect to the anchor shoe.

* * * * *